US006224525B1

(12) United States Patent
Stein

(10) Patent No.: US 6,224,525 B1
(45) Date of Patent: May 1, 2001

(54) EXERCISER FOR MUSCLE GROUPS OF THE PELVIS

(76) Inventor: Daniel S. Stein, P.O. Box 49072, St. Petersburg, FL (US) 33743

( * ) Notice: Subject to any disclaimer, the term of this patent is extended or adjusted under 35 U.S.C. 154(b) by 0 days.

(21) Appl. No.: 09/426,556

(22) Filed: Oct. 22, 1999

(51) Int. Cl.[7] ..... A63B 21/02; A61F 2/00
(52) U.S. Cl. ..... 482/148; 482/121
(58) Field of Search ..... 482/10, 11, 148, 482/121–126, 128; 600/29, 30; 128/885, DIG. 25

(56) References Cited

U.S. PATENT DOCUMENTS

| | | | | |
|---|---|---|---|---|
| 1,851,865 | * | 3/1932 | Ptacek | 482/11 |
| 1,928,893 | | 10/1933 | Hoard | 128/341 |
| 2,763,265 | | 9/1956 | Waters | 128/343 |
| 4,241,912 | | 12/1980 | Mercer et al. | 128/341 |
| 4,280,696 | * | 7/1981 | Ramon | 482/11 |
| 4,574,791 | | 3/1986 | Mitchener | 128/79 |
| 4,583,542 | * | 4/1986 | Boyd | 128/341 |
| 4,971,036 | | 11/1990 | Collins | 128/17 |
| 5,407,412 | | 4/1995 | Plevnik et al. | 482/105 |
| 5,554,092 | | 9/1996 | Harpstead et al. | 482/148 |
| 5,755,236 | * | 5/1998 | Dann et al. | 128/885 |

OTHER PUBLICATIONS

American Sex Machines The Hidden History of Sex At The U.S. Patent Office (Author: Hoag Levins).

Kegelmaster The World's First Progressive Resistance Vaginal Exerciser!

* cited by examiner

*Primary Examiner*—Stephen R. Crow
(74) *Attorney, Agent, or Firm*—Pettis & Van Royen, P.A.

(57) ABSTRACT

An exercise device for strengthening the muscles of the pelvis, particularly the collective group of muscles involved in human sexual response, which are also important for controlling the evacuation of the intestines and the bladder. This exercise device focuses on increasing the mass, strength and tone of these muscles. The device comprises a pair of longitudinally extending members that are connected to one another at their first ends. The opposing second ends of these members are movable between an open position and a closed position, but are biased toward the open position providing resistance to movement toward the closed position. In the open position the second ends of the members are spaced apart from one another further than the first ends of the members are spaced apart from one another. The device is sized and configured to be received within the vaginal and anal cavities of the human body to exercise the groups of muscles related thereto.

6 Claims, 4 Drawing Sheets

EXERCISER FOR MUSCLE GROUPS OF THE PELVIS

BACKGROUND OF THE INVENTION

1. Field of the Invention

The present invention relates to an exercise device for strengthening the muscles of the pelvis, particularly the collective group of muscles involved in human sexual response, which are also important for controlling the evacuation of the intestines and the bladder. The exercise device focuses on increasing the muscle mass, strength and tone of these muscles.

2. Description of the Prior Art

The lower pelvic muscles may become damaged or weakened through childbirth, lack of use, age or other reasons. One of the symptoms related to a weakening of these muscles is urinary incontinence. Various exercise devices were developed in an attempt to strengthen the pelvic muscles, with the specific goal of strengthening the muscles that surround the urethra to overcome urinary incontinence in women.

Perhaps the oldest patented device is disclosed in U.S. Pat. No. 1,928,893 that was issued to Dr. Ralph D. Hoard in 1933. The device was designed to be inserted in a patient's vagina to exercise the vaginal muscles. It is comprised of a two sided tubular apparatus whose sides are held slightly apart by springs. The sides of the tubular device are squeezed shut against the pressure of the springs by the vaginal muscles.

A number of devices were invented by Dr. Arnold Kegel; some devices use a pressurized sleeve that is inserted within the vagina to exercise the muscle tissue within and around the vagina and to measure their strength. Another Kegel device comprises a solid elongate shaft, having a varied cross-section, which is inserted within the vagina so that the patient can squeeze the muscles of the vagina, as well as many of the other muscle groups in the lower pelvis, against the hard, unyielding device, providing isometric exercise. It was discovered that strengthening these muscles increased the patient's sexual response.

Additional patents were issued for a number of other isometric exercisers, including U.S. Pat. No. 2,763,265, issued to E. G. Waters and U.S. Pat. No. 5,554,092, issued to Stanley D. Harpstead, et al. The Waters device is a generally hard tubular device that has varying cross sectional dimensions for assistance in identifying the various muscle groups and for applying isometric exercise to those muscle groups within or connected to the vagina. The Harpstead device is a hollow body designed to receive various configurations of weights. When inserted within the vagina the muscles of the vagina and the pelvic area must be constricted to hold the device therein.

Notwithstanding the existence of such prior art exercisers, it remains clear that there is a need for an exerciser that dynamically exercises the muscle groups, is simple to use, has a low risk of injury and is easy to maintain.

SUMMARY OF THE INVENTION

The present invention relates to an exerciser for the muscles of the pelvis, particularly the collective group of muscles involved in human sexual response. The proper conditioning of these muscles is also important for maintaining good health and body function. One preferred embodiment of the device of the present invention comprises a pair of longitudinally extending members that are connected to one another at their first ends. The opposing second ends of these members are movable between an open position and a closed position, but are biased toward the open position providing resistance to movement toward the closed position. In the open position the second ends of the members are spaced apart from one another further than the first ends of the members are spaced apart from one another. A gripper, having a first part formed on one member proximal to the first end of that member and a second part formed on the other member proximal to the second end of that member. The gripper is used to grasp the device with one hand so that the second ends may be moved from the open position toward the closed position. The device is sized and configured to be received within the vaginal and anal cavities of the human body to exercise the groups of muscles related thereto.

The invention accordingly comprises an article of manufacturer possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DESCRIPTION OF A PREFERRED EMBODIMENT

Figure 1:
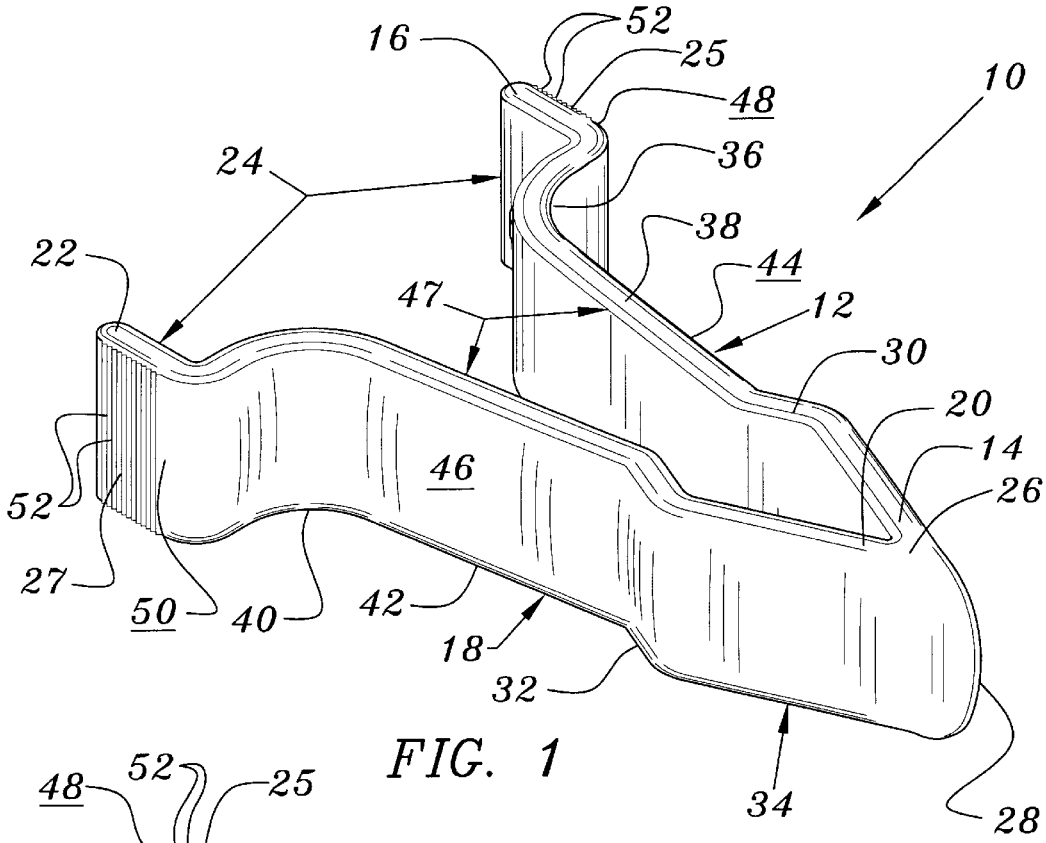
FIG. 1 is an isometric view of a preferred embodiment of the exerciser of this invention.
Figure 2:
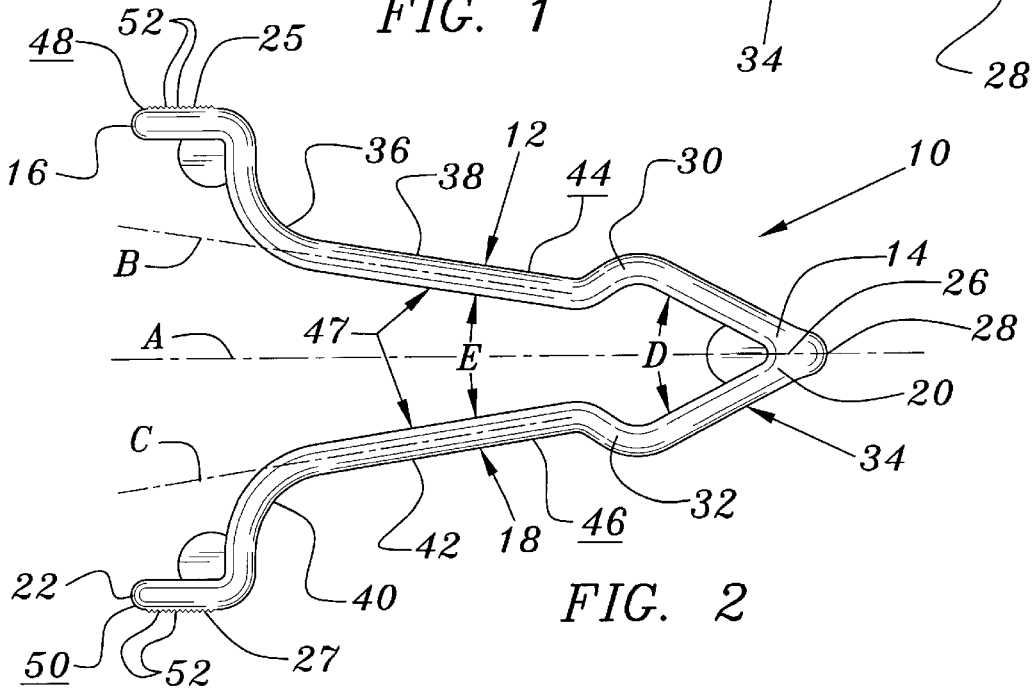
FIG. 2 is a top plan view of the invention of FIG. 1, which also comprises the identical bottom plan view.
Figure 3:
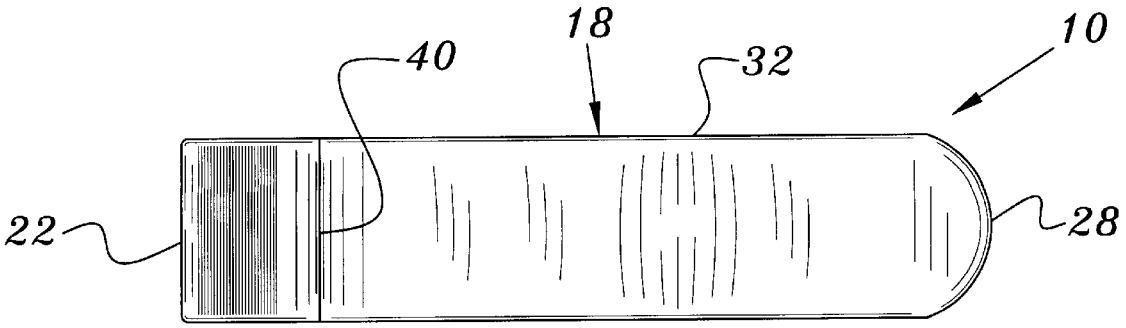
FIG. 3 is a left side elevational view of the invention of FIG. 1, the right side elevational view being a mirror image thereof.
Figure 4:
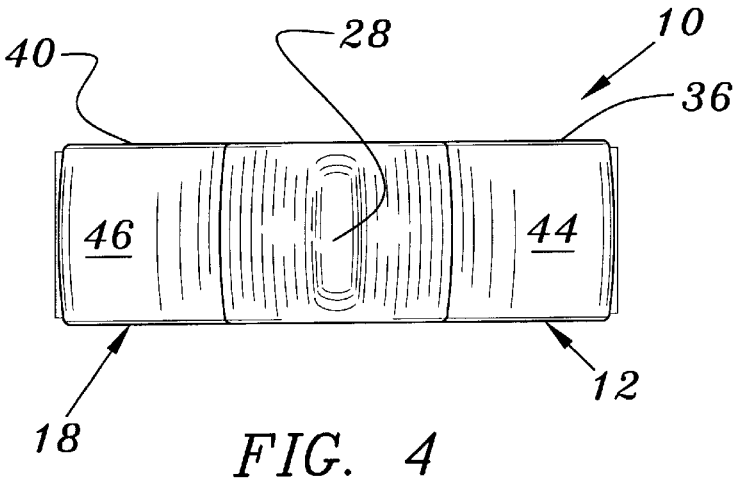
FIG. 4 is a front elevational view of the invention of FIG. 1.
Figure 5:
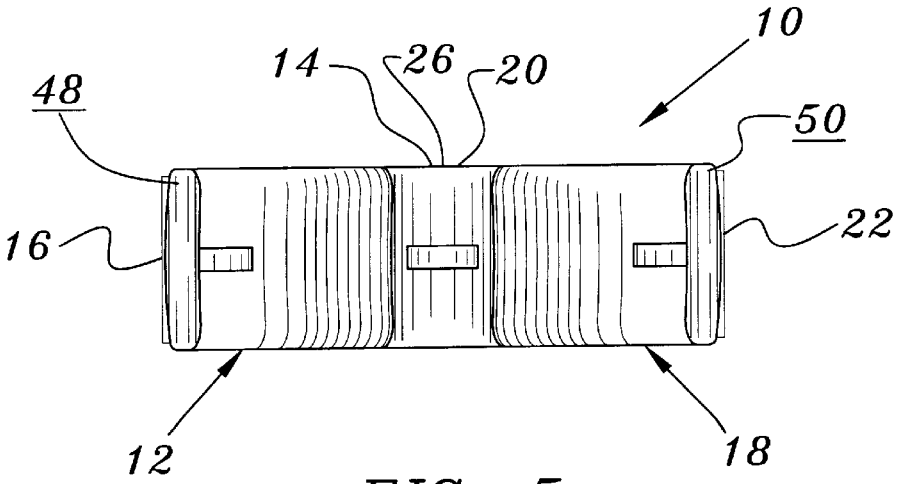
FIG. 5 is a rear elevational view of the invention of FIG. 1.
Figure 6:
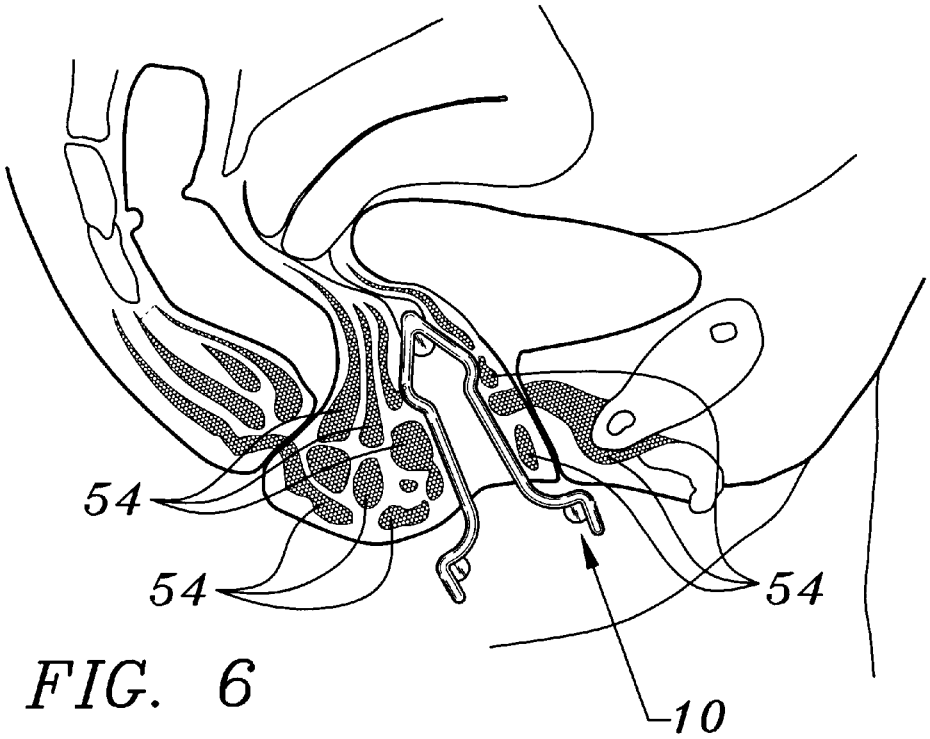
FIG. 6 is a line drawing of a portion of the female human anatomy, illustrating the position of the exerciser inserted within the vaginal cavity with the muscles relaxed.
Figure 7:
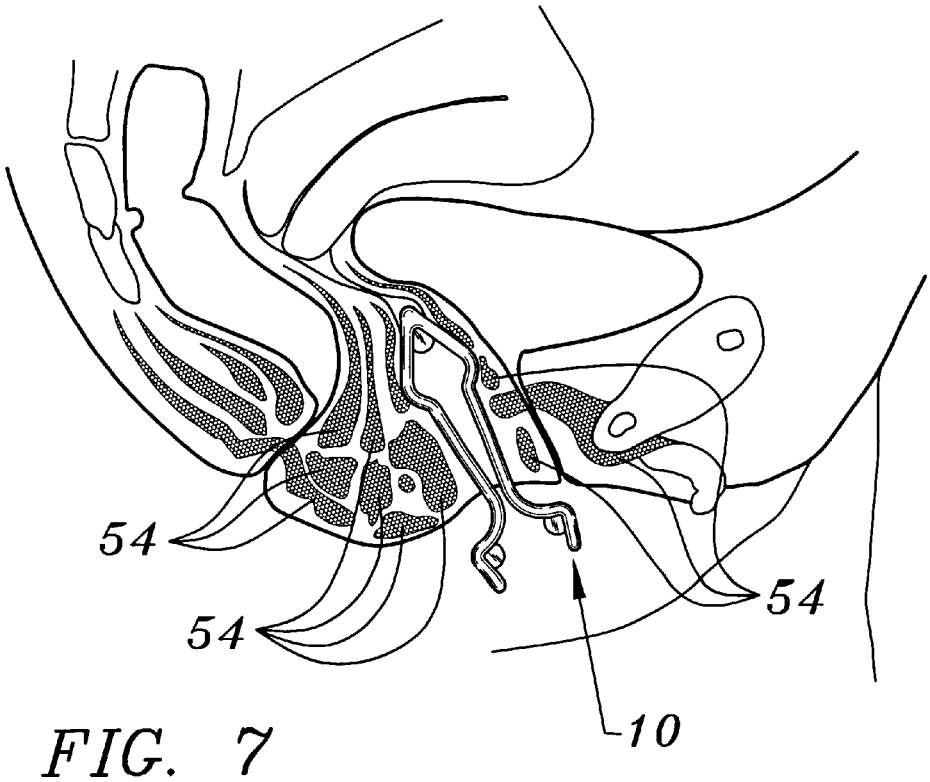
FIG. 7 is the line drawing of FIG. 6 illustrating the exerciser with the muscles contracted.
Figure 8:
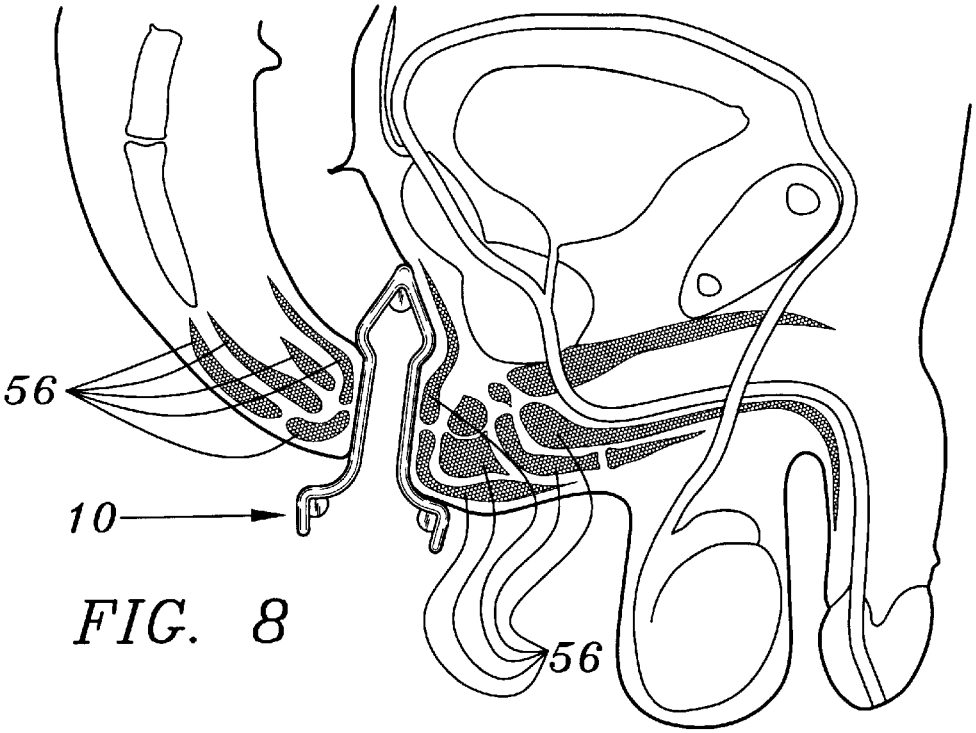
FIG. 8 is a line drawing of a portion of the male human anatomy, illustrating the positioning of the exerciser within the anal cavity with the muscles relaxed.
Figure 9:
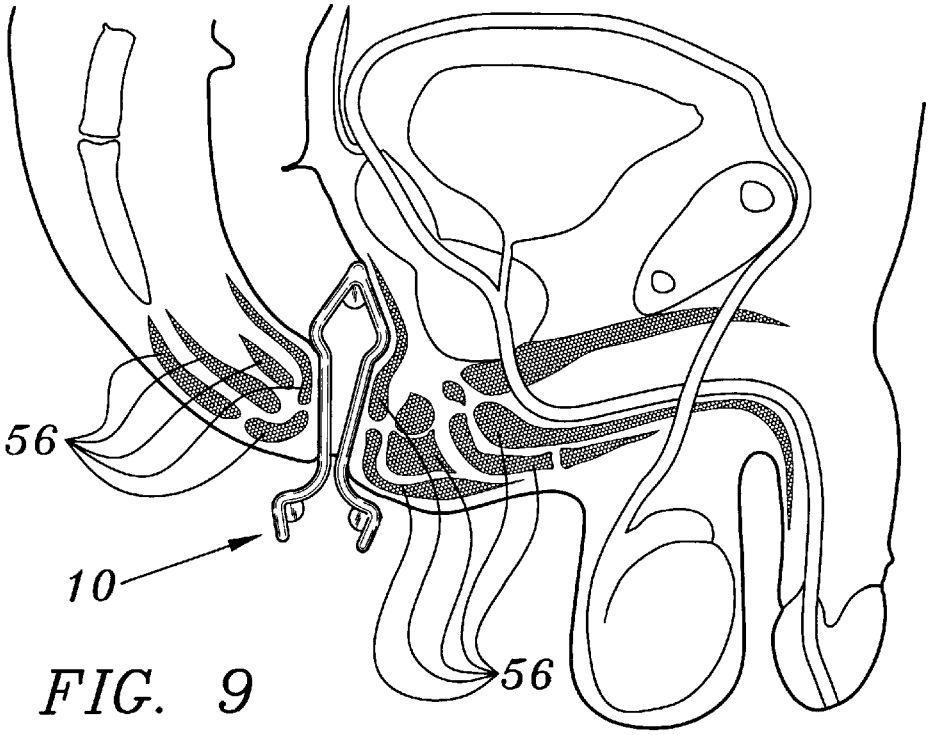
FIG. 9 is the line drawing of FIG. 8 illustrating the exerciser with the muscles contracted.

A preferred embodiment of the exercise device of this invention is illustrated in the drawing FIGS. 1–5, and the use of the device is illustrated in FIGS. 6–9. The exercise device is generally indicated as 10 throughout the FIGS. 1–9. Referring first to the view of FIG. 1, it can be seen that the device 10 comprises a first longitudinally extending member 12, having a first end 14 and a second end 16, and a second longitudinally extending member 18, having a first end 20 and a second end 22. The first end 14 of the first member 12 is connected to the first end 20 of the second member 18 so that the second ends 16 and 22 are movable from an open position, as seen in FIG. 2, toward a closed position as seen in FIGS. 7 and 9. Additionally, when the device is in the open position, the second ends 16 and 22, of the members 12 and 18 respectively, are biased apart from one another so that they are spaced further apart from one another than the first ends 14 and 20. The exercise device 10 further comprises a gripper, shown generally as 24, which is comprised of a first part and a second part. The first part 25 of the gripper 24 comprises a portion of the first member 12 that includes the second end 16 of the first member 12. The second part 27 of the gripper 24 comprises a portion of the second member 18 which includes the second end 22 of the second member 18.

The first ends 14 and 20 are joined to one another so that the second ends 16 and 22 are biased away from one another toward the open position. In this preferred embodiment, illustrated in FIGS. 1–5, the device 10 is formed in the open position from a resilient synthetic resin with the first end 14 of the first member 12 being contiguously joined to the first end 20 of the second member 18. By being constructed from a resilient material with a memory and by being formed in the open position, when the second ends 16 and 22 are flexed toward one another, the members 12 and 18 are biased away from one another and resist movement toward the closed position. The amount of resistance provided by the device 10 is determined by the flexibility of the material selected and by the thickness of that material. By varying the thickness of the members 12 and 18 and/or by selecting less resilient material, an exercise device 10 having increased resistance may be constructed. Materials, other than resilient synthetic resins, that are suitable for the purpose may be used.

In another preferred embodiment, the first ends 14 and 20 may be joined by a spring, not shown, that is covered by a protective covering. In another preferred embodiment, the members of the device 10 may be spaced apart by a wedge shaped portion of resilient material, not shown, to provide resistance to movement of the first and second members toward the closed position.

The first ends 14 and 20, of the first and second members 12 and 18 respectively, are connected so that the first and second members are angled away from one another and the longitudinal axes B and C of the first and second members respectively, lie generally in the same plane. In a preferred embodiment the angle D, as seen in FIG. 2, is approximately 55 degrees and the angle E, also shown in FIG. 2, is approximately 20 degrees; however, in other preferred embodiments these angles may vary. At the connection point 26, the members are joined and are formed into a rounded, smooth, arcuate leading-edge 28, as seen clearly and FIGS. 1,2 and 3.

The first member 12 is formed with a first segment 30 that is angled inwardly of the device 10 to form an offset in the member 12. Likewise the second member 18 is formed with a second segment 32 that is angled inwardly of the device 10 to form an offset in the member 18. The segments 30 and 32 and the portion of each member 12 and 18 that extends from the segments 30 and 32 to the leading-edge 28 forms the head, shown generally as 34, of the device 10.

The first member 12 is formed with a third segment 36, that is proximal to the second end 16 of the first member 12, the third segment 36 being arcuate, curves outwardly of the device 10, from an adjacent generally straight section 38 of the member 12. This generally straight section 38 of the first member 12 joins the first segment 30 with the third segment 36. Likewise, the second member 18 is formed with a fourth segment 40 that is proximal the second end 22, of the second member 18, the fourth segment 40 being arcuate, curving outwardly of the device 10 from an adjacent generally straight section 42 of the member 18. This generally straight section 42 of the second member 18 joins the second segment 32 with the fourth segment 40. The outwardly facing surface 44 of the first member 12 and the outwardly facing surface 46 of the second member 18 are each convex, as clearly seen in FIG. 4. The straight section 38 of the first member 12 and the straight section 42 of the second member 18 together comprise the shank of the device 10, identified generally as 47.

The first part 25 of the gripper 24, is adjacent the third segment 36 of first member 12. and the second part 27 of the gripper 24 is adjacent the fourth segment 40 of the second member 18. In a preferred embodiment, the first part 25 and the second part 27 are generally parallel to one another and are also generally parallel to the longitudinal axis A of the device 10. In other embodiments, the parts 25 and 27 may lie at an angle to the longitudinal axis A. The outwardly facing surface 48 of the first part 25 and the outwardly facing surface 50 of the second part 27 of the gripper 24 are each roughened to prevent slippage of the fingers while the device 10 is being gripped. In this preferred embodiment illustrated in the drawings, grooves and ridges 52 are formed therein; however any suitable surface may be used.

The exercise device 10 is sized and configured to be received within the vaginal and anal cavities of the human body to exercise the groups of muscles related thereto. In a preferred embodiment, the device 10 may have the following typical dimensions. In the open position, the device 10 is 3¾ inches in length from the leading edge 28 to the third segment 36 or to the fourth segment 40. The first and second members 12 and 18 respectively are spaced apart approximately 1 inch at the beginning of the first and second segments 30 and 32 respectively and are spaced apart ⅝th of an inch at the ends of the first and second segments 30 and 32 respectively. At the beginning of the third and fourth segments 36 and 40 respectively the first and second members 12 and 18 are spaced apart approximately 1⅜ths inches. In this embodiment, each member is approximately ⅛th inch thick. Obviously, the structure of the human body varies such that the exercise device 10 may be manufactured in different sizes with different dimensions to ensure comfort for the user, the sizes being provided being typical of one preferred embodiment only. Also, as previously discussed, the resistance of the device 10 to flexure may be adjusted by using less flexible material or by constructing the members from thicker material.

Having thus set forth a preferred construction for the current invention, it is to be remembered that this is but the preferred embodiment. Attention is now invited to a description of the use of the exercise device 10. The exercise device 10 is used to strengthen the muscles of the pelvis, particularly the collective group of muscles involved in human sexual response, which are also important for controlling the evacuation of the intestines and the bladder. The exercise device 10 focuses on increasing the muscle mass, strength and tone of these muscles by providing progressive resistance. Passive exercisers that use the squeeze, hold, release and repeat technique, do not achieve a significant increase in muscle mass or tone.

The particular group of muscles that control evacuation of the bladder, evacuation of the bowel and sexual response are the genital and anal muscles that include fibers from several groups of the pelvic muscles, which contract together around the bladder, urethra, rectum, and around the lower third of the vagina in women and the hidden third of the penis in men. These muscles include the pubococcygeus muscle, the iliococcygeus muscle, the deep transverse and superficial transverse perineal muscles, bulbocavernosus muscle and the Ischiocavernosus muscle. Many of the muscle fibers are interlaced, particularly around the rectum and the vagina so that exercising the muscles related to both the anal cavity and the vagina provide improvement in sexual response and general health of the pelvic area.

To use the device the patient should lie down in a comfortable position with their knees up. If the device 10 is being inserted into the vagina, ensure that the vulva and the device 10 are lubricated with a water-soluble lubricant. If the device 10 is being inserted into the anal cavity, ensure that the anus and the device 10 are lubricated. For anal exercise a kneeling position may also be used. Grasp the gripper 24 between the fingers and thumb of one hand and move the device 10 to the closed position by squeezing the gripper 24. As shown in FIG. 6 and 8 the device 10 is inserted into the body cavity so that it flexes in a front to back fashion until the head 34 of the device 10 is comfortably beyond most of the muscle groups. The muscle groups are shown generally as 54 in FIGS. 6 and 7 for a female patient, and for the male patient the muscle groups are shown generally as 56 in FIGS. 8 and 9. FIG. 6 shows insertion in the vagina of a female patient while FIG. 8 shows insertion in the anal cavity of a male patient. FIGS. 6 and 8 show the device 10 inserted with the muscle groups relaxed and the device 10 proximal to the open position. The head 34 of the device 10 will assist in preventing the device 10 from being expelled by the muscle contractions. The device should be sized and configured so that the muscle contractions should largely be applied around the shank 47 of the device 10. FIGS. 7 and 9 illustrate the muscles being contracted and the device 10 being moved toward the closed position. The patient, by squeezing the same muscles that are used to stop a urine flow or a bowel movement, squeezes the device 10 for as long as it is comfortable and then relaxes completely. There should be a full relaxation of the muscle groups between full contractions. This contraction and relaxation should be repeated about 21 times, comprising a set. If the patient is able they should complete three sets with 15 seconds of relaxation between each set. When the patient is able to comfortably accomplish these repetitions the patient may increase the number of sets and/or move up to a firmer device which requires greater strength of the muscle groups to obtain full contraction.

Any muscle in the body will a trophy, weaken and get soft, thin and flabby without being used. The device 10, through the use of an exercise program similar to that described above, will strengthen these weakened muscles improving the patient's health and the patient's capability for sexual response.

It should be noted, as well, that the process of childbirth through vaginal delivery may result in the stretching and weakening of the vagina as well as bladder, vaginal, and related musculature. This is particularly true in childbirth with an infant over eight pounds or an unusually rapid delivery. In these cases, weakened muscles may cause associated involuntary urinary leakage precipitated by sudden physical stress such as laughing, coughing, or sneezing. As an alternative to the surgical tightening of these muscles, the use of this invention to exercise and thus increase the tone, strength, and control of these muscles may reduce or eliminate these troubling symptoms and then obviate the necessity for surgery in cases of stress urinary incontinence.

In addition to stress urinary incontinence, the gaping of the vagina due to childbirth stretching may be reduced or prevented by the postpartum preventative use of the invention and these problems of uterine prolapse, cystocele, rectocele, pelvic relaxation syndrome, reduced penile contact and attendant potential sexual dysfunction and orgasmic dysfunction may be treated or prevented or symptoms reduced and minimized, thus potentially avoiding costly and risky surgical procedures by the use of the invention preventatively.

It will thus be seen that the objects set forth above, among those made apparent from the proceeding description, are efficiently attained and, since certain changes may be made in the above article without departing from the scope of the invention, it is intended that all matter contained in the above description or shown in the coming drawings shall be interpreted as illustrative and not to limiting sense.

It is also to be understood that the following claims are intended to cover all of the generic and specific features of the invention herein described, and all statements of the scope of the invention which, as a matter of language, might be said the fall therebetween. Now that the invention has been described,

What is claimed is:

1. An exercise device for exercising muscles of the pelvis comprising:

a first longitudinally extending member having a first end and a second end;

a second longitudinally extending member having a first end and a second end, said first end being connected to said first end of said first member, said second ends being movable between an open position and a closed position and said second ends being biased toward said open position, such that in said open position, said second ends of said first and second members are spaced apart from one another further than said first ends are spaced apart from one another;

a first segment formed in said first member proximal said first end of said first member;

a second segment formed in said second member proximal said first end of said first member, said first and second segments being angled inwardly of said device, toward one another, thereby creating an inwardly extending offset in each of said first and second members; and said first and second members being sized and configured such that said first ends are received within the vaginal and anal cavities of the human body, for exercise of muscles of the pelvis.

2. An exercise device as in claim 1, wherein said first end of said first member and said first end of said second member are contiguously connected to one another.

3. An exercise device as in claim 1, wherein a first segment proximal said first end of said first member and a second segment proximal said first end of said second member are each angled inwardly of said device, toward one another, thereby creating an inwardly extending offset in each of said first and second members.

4. An exercise device as in claim 1, wherein a third segment proximal said second end of said first member and a fourth segment proximal said second end of said second member are each curved away from one another.

5. An exercise device as in claim 1, further comprising a gripper having a first portion formed in the first member to include the second end of the first member, and a second portion formed in the second member to include the first end of the second member, whereby said first and second portions may be gripped and said members moved from said open position toward said closed position.

6. An exercise device as in claim 5, wherein said first portion and said second portion of said gripper are generally parallel to one another and to a centerline extending through said device.

* * * * *

UNITED STATES PATENT AND TRADEMARK OFFICE

CERTIFICATE OF CORRECTION

PATENT NO. : 6,224,525 B1
DATED : May 1, 2001
INVENTOR(S) : Stein, Daniel S.

It is certified that error appears in the above-identified patent and that said Letters Patent is hereby corrected as shown below:

Column 6,
Lines 46-51, delete claim 3.

Signed and Sealed this

Second Day of April, 2002

*Attest:*

*Attesting Officer*

JAMES E. ROGAN
*Director of the United States Patent and Trademark Office*